United States Patent [19]

Robitaille

[11] 4,130,397

[45] Dec. 19, 1978

[54] COMBUSTION ENGINE EXHAUST GAS AFTERBURNER

[76] Inventor: George L. Robitaille, 64 Pollock Rd., Latham, N.Y. 12110

[21] Appl. No.: 841,475

[22] Filed: Oct. 12, 1977

[51] Int. Cl.[2] ..... F01N 3/10; F01N 7/10

[52] U.S. Cl. ..... 422/168; 60/303; 422/176

[58] Field of Search ..... 23/277 C; 60/303; 181/227, 228

[56] References Cited

U.S. PATENT DOCUMENTS

| | | | |
|---|---|---|---|
| 2,981,057 | 4/1961 | Butler | 60/303 |
| 3,247,666 | 4/1966 | Behrens | 23/288 F |
| 3,256,027 | 9/1973 | Gotoh et al. | 23/277 C |
| 3,633,368 | 1/1972 | Rosenlund | 23/277 C |
| 3,661,529 | 5/1972 | Karoudis | 23/277 C |
| 3,751,920 | 8/1973 | Rosenlund | 23/277 C |
| 3,805,523 | 4/1974 | Tanasawa | 60/298 |
| 3,904,374 | 9/1975 | Rosenlund | 23/277 C |
| 3,957,446 | 5/1976 | Mayer et al. | 60/303 |
| 4,047,895 | 9/1977 | Urban | 23/288 F |

*Primary Examiner*—Morris O. Wolk

*Assistant Examiner*—Bradley R. Garris

*Attorney, Agent, or Firm*—Clarence A. O'Brien; Harvey B. Jacobson

[57] ABSTRACT

An elongated tubular body is provided including opposite end walls and a longitudinally central transverse partition dividing the interior of the body inwardly of the end walls into opposite end portions of the interior. A pair of tube sections are disposed lengthwise within the body between and sealed against the opposite sides of the partition and the opposing end walls with the outer surfaces of the tube sections spaced inwardly of the opposing inner surfaces of the body to define annular chambers extending about the tube sections inwardly of the body. The body includes exhaust gas inlet structure opening laterally into one of the chambers and exhaust gas outlet structure opening laterally outwardly from the other chamber. The tube sections each include exhaust gas passage openings formed therein at points spaced thereabout and longitudinally therealong and the partition includes exhaust gas passage openings formed therethrough communicating the interiors of the chambers.

11 Claims, 3 Drawing Figures

COMBUSTION ENGINE EXHAUST GAS AFTERBURNER

BACKGROUND OF THE INVENTION

With the present emphasis on lessening air pollution caused by the operation of combustion engines, various different forms of afterburners have been designed to assist in the complete combustion of all of the unburned fuel exhausted from combustion engines. However, most afterburners which operate with reasonable efficiency are expensive to produce and quite cumbersome. In addition, some forms of afterburners function as catalytic converters and their efficiency to so function is substantially reduced, or terminated, in the event the associated combustion engine burns more than a minimal amount of leaded fuel. Accordingly, a need exists for a compact inexpensive and operationally reliable afterburner.

Various forms of afterburners and other devices for treating the exhaust gases of combustion engines to lessen the pollutants therein are disclosed in U.S. Pat. Nos. 2,981,057, 3,042,499, 3,722,221, 3,805,523, 3,837,814, 3,924,407, 3,957,446 and 3,982,397.

SUMMARY OF THE INVENTION

The afterburner of the instant invention has been specifically designed for use in conjunction with internal combustion engines of the type that presently are utilized to power motor vehicles. However, the afterburner may also be utilized in conjunction with stationary internal combustion engines and internal combustion engines utilized to propel other types of vehicles.

The afterburner includes a cylindrical body closed at its opposite ends and including a center transverse partition having gas passage openings formed therein. A pair of tube sections are disposed in the opposite end portions of the tubular body in spaced relation relative to the latter and with the opposite ends of the tube sections sealed relative to the end walls of the tubular body and opposite sides of the partition outwardly of the gas passage openings formed therein. The tube sections each include circumferantially and longitudinally spaced gas passage openings formed therein and the tube sections are constructed of a refractory material such as carbon. Further, the tubular body includes exhaust gas inlet means opening laterally thereinto in one end portion of the body and exhaust gas outlet structure opening outwardly of the other end of the body. The passage of hot exhaust gases through the afterburner causes the internal surfaces thereof to be highly heated and the passage of the exhaust gases through the various exhaust gas passage openings within the afterburner causes the exhaust gases to be accelerated and thus the portions of the internal components of the afterburner to be even more greatly heated to effect complete burning of substantially all of the unburned fuel components contained within the exhaust gases passing through the afterburner. The interior of the afterburner includes electrical resistance heating means for heating the interior of the afterburner for use upon initial starting of the associated combustion engine in order to promote more rapid heating of the afterburner.

The main object of this invention is to provide an afterburner which will be operative to burn substantially all fuel components entrained in the exhaust gases from an associated internal combustion engine.

Another object of this invention is to provide an afterburner constructed in a manner whereby its capacity for treating exhaust gases is relatively great in proportion to the over-all size of the afterburner.

Still another object of this invention is to provide an afterburner including internal refractory material components which may be readily replaced.

A still further object of this invention is to provide an afterburner including electrical resistance heating means whereby heating of the interior of the afterburner to operating temperatures may be enhanced upon initial starting of the associated combustion engine.

A further object of this invention is to provide an afterburner which may be readily constructed of various sizes so as to be adaptable for use in conjunction with combustion engines of various displacements.

A final object of this invention to be specifically enumerated herein is to provide an afterburner in accordance with the preceding objects and which will conform to conventional forms of manufacture, be of simple construction and efficient in operation so as to provide a device that will be economically feasible, long lasting and relatively trouble-free.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
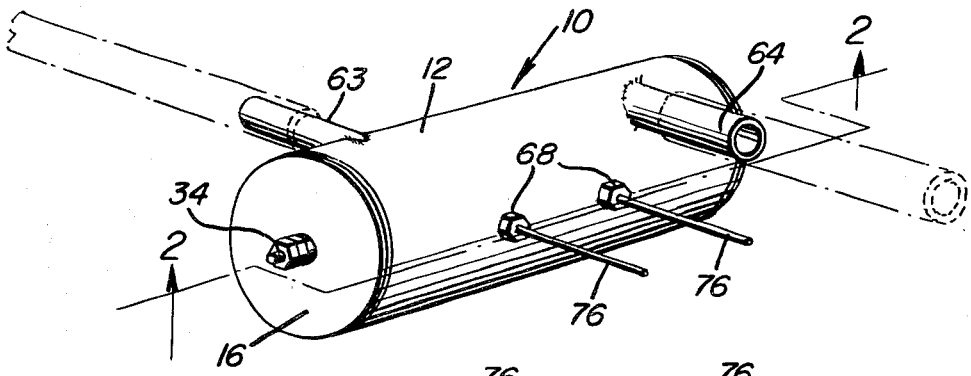
FIG. 1 is a perspective view of the afterburner of the instant invention.
Figure 2:
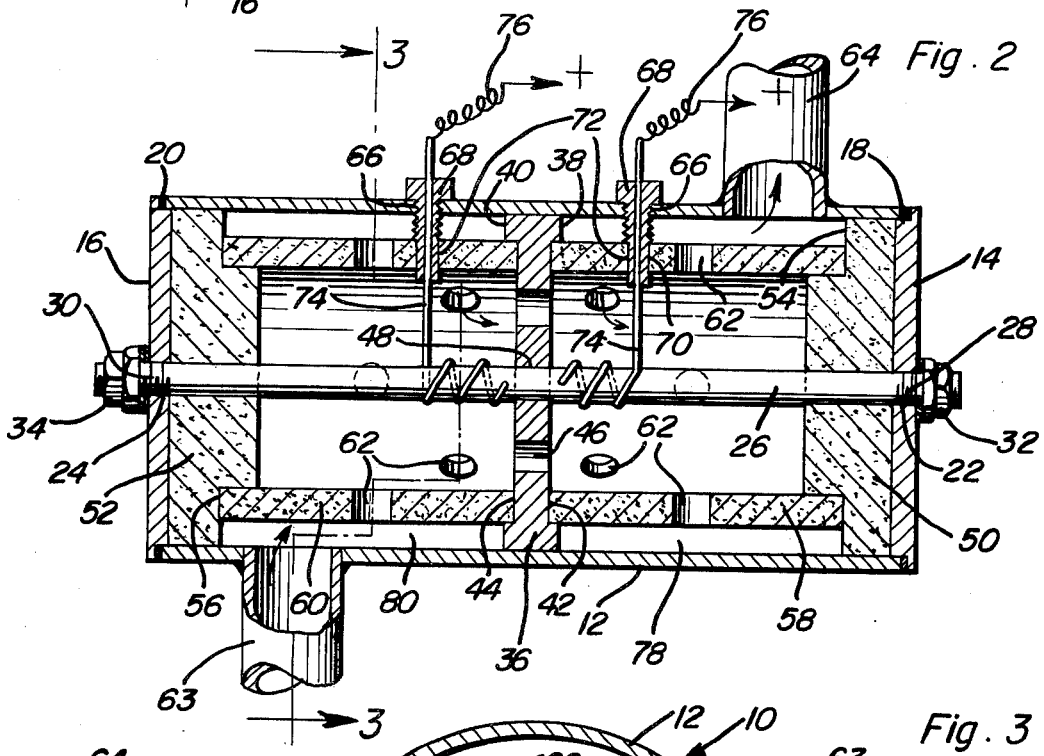
FIG. 2 is an enlarged, fragmentary, horizontal sectional view taken substantially upon the plane indicated by the section line 2—2 of FIG. 1.
Figure 3:
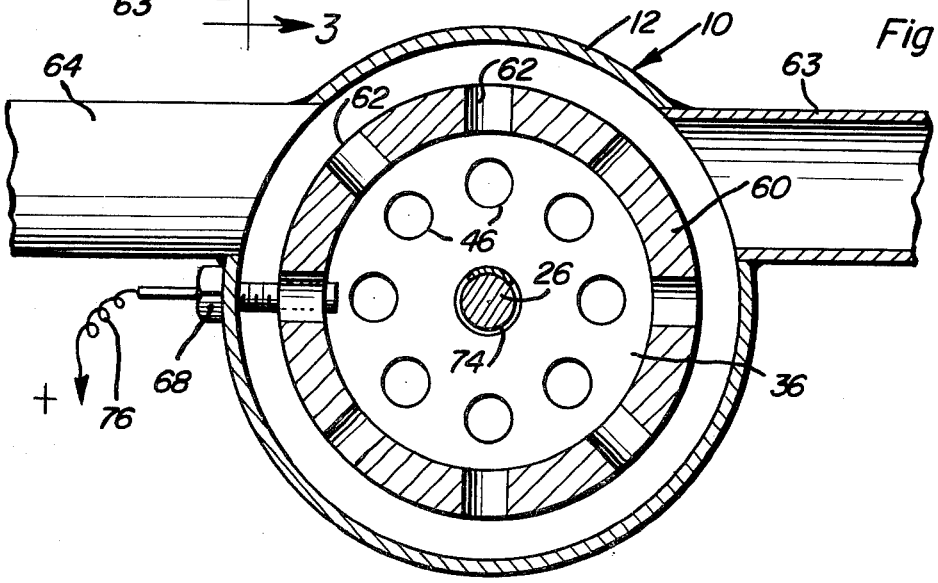
FIG. 3 is an enlarged, transverse, vertical sectional view taken substantially upon the plane indicated by the section line 3—3 of FIG. 2.

Referring now more specifically to the drawings, the numeral 10 generally designates the afterburner of the instant invention. The afterburner 10 includes an elongated cylindrical body 12 including a pair of removable opposite end walls 14 and 16. A pair of annular asbestos gaskets 18 and 20 are interposed between the opposing axial faces of the end walls 14 and 16 and the corresponding ends of the body 12 and the end walls 14 and 16 have central openings 22 and 24 formed therethrough. An elongated rod 26 extends axially through the body 12 and the openings 22 and 24 and is threaded on its opposite ends as at 28 and 30. A pair of threaded fasteners 32 and 34 are threaded on the extended ends of the rod 26 and thus retain the end walls 14 and 16 tightly against the opposite ends of the body 12.

The longitudinal center of the body 12 includes a transverse partition disk 36 which is snugly but slidably received within the body 12 and is removable through either end thereof. The opposite side faces 38 and 40 of the partition 36 include relieved central portions 42 and 44 and the relieved central portion of the partition 36 includes peripherally spaced gas passage openings 46 formed therethrough and a central bore 48 formed therethrough. The central portion of the rod 26 is snugly received through the bore 48.

A pair of thick cylindrical disks 50 and 52 are snugly received within the opposite ends of the body 12 inwardly of the end walls 14 and 16 and the disks 50 and 52 include relieved outer peripheral portions 54 and 56.

A pair of tube sections 58 and 60 are disposed within the opposite end portions of the body 12 and have their adjacent ends seated in the relieved portions 42 and 44 and their remote ends seated in the relieved portions 54 and 56. The disks 50 and tube sections 58 and 60 are constructed of refractory material such as graphite carbon.

The tube sections 58 and 60 each have longitudinally and circumferentially spaced gas passage openings 62 formed therein and one end portion of the body 12 includes an exhaust gas inlet neck 63 opening thereinto along a chord of the body 12 and the other end portion of the body 12 includes a gas outlet neck 64 opening outwardly thereof along a chord of the body 12.

One side wall portion of the body 12 has a pair of threaded bores 66 formed therethrough and the bores 66 have mounting sleeves 68 threaded thereinto including diametrically reduced inner ends 70 snugly received in radial bores 72 formed in corresponding wall portions of the tube members 58 and 60. The sleeves 68 receive resistance heating element wires 74 therethrough and the outer ends of the wires 74 are electrically connected to a suitable source (not shown) of electrical potential by means of conductors 76. The other ends of the wires 74 are coiled about and grounded to the rod 26, the rod 26, the end walls 14 and 16 and the body 12 being constructed of conductive metal and either one or both of the end walls 14 and 16 being grounded relative to the aforementioned source.

The tube sections 58 and 60 are of smaller outside diameter than the inside diameter of the body 12 whereby annular chambers 78 and 80 are defined on opposite sides of the partition 36 outwardly of the tube sections 58 and 60 inwardly of the body 12. The inlet neck 63 opens into the chamber 80 and the outlet neck 64 opens outwardly of the chamber 78. Further, the gas passage openings 62 formed in the tube section 58 open outwardly into the chamber 78 and the gas passage openings 62 formed in the tube section 60 open outwardly into the chamber 80.

From the foregoing, it will be understood that the exhaust gases entering the body 12 through the inlet neck 63 pass inwardly of the tube section 60 through the openings 62 therein. Thereafter, the exhaust gases pass through the openings 46 and into the interior of the tube section 58. Thereafter, the exhaust gases pass outwardly through the gas passage openings 62 formed in the tube section 58 into the chamber 78 from which the exhaust gases are thereafter discharged through the neck 64.

As the exhaust gases pass through the heat exchanger 10, the heat exchanger 10, and particularly the tube sections 58 and 60 constructed of refractory material and the partition 36 which may be conveniently constructed of stainless steel are highly heated and as the exhaust gases pass through the various openings 62 and 46, they are accelerated thus more greatly heating those portions of the tube sections 58 and 60 and the partition 36 defining the openings 62 and 46. The high heat of these portions of the afterburner 10 insure that substantially all of the unburned fuel components in the exhaust gases passing through the afterburner 10 are thoroughly burned.

When the associated internal combustion engine is about to be started, suitable electrical potential may be supplied to the wires 74 in order that the interior of the afterburner 10 may be preheated immediately prior to the combustion engine being started. Thus, the afterburner is operative to reduce air pollutants even when the associated combustion engine has just been started. However, as soon as the associated combustion engine has been operated for a predetermined length of time sufficient to effect complete heating of the afterburner 10, the supply of electrical potential to the wires 74 may be terminated and further heating of the afterburner 10 will be accomplished by the heat of exhaust gases passing therethrough.

The rod 26, end walls 14 and 16 and the body 12 may also be constructed of stainless steel. Further, the afterburner 10 may be constructed of substantially any size so as to be operational as desired when used in conjunction with a combustion engine of a given displacement.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An afterburner comprising an elongated tubular body including opposing end walls closing the opposite ends thereof and a central transverse partition dividing the interior of said tubular body inwardly of said end walls into inlet and outlet portions, a pair of tube sections disposed lengthwise within said body between and sealed against opposite sides of said partition and the opposing end walls and the outer radial surfaces of said tube sections spaced inwardly of the opposing inner radial surfaces of said body, whereby annular chambers are disposed about said tube sections inwardly of said body between opposite sides of said partition and the respective opposing end walls, said body including exhaust gas inlet means opening laterally into said inlet portion of said body and the corresponding chamber and exhaust gas outlet means opening laterally outwardly from said outlet portion of said body and from the corresponding chamber, said tube sections each including exhaust gas passage openings formed therein at points spaced thereabout and longitudinally therealong, said partition including exhaust gas passage openings formed therethrough, said exhaust gas passage openings connecting the interiors of said chambers.

2. The combination of claim 1, wherein said inlet means opens into said inlet portion of said body along a chord thereof and said outlet means opens outwardly from said outlet portion of said body along a chord thereof.

3. The combination of claim 1, wherein said tube sections and body are generally cylindrical.

4. The combination of claim 1, wherein said tube sections are constructed of refractory material.

5. The combination of claim 4, wherein said tube sections are constructed of carbon.

6. The combination of claim 1, wherein said partition includes relieved opposite side surface portions in which the adjacent ends of said tube sections are seated.

7. The combination of claim 6, wherein the opposing end walls of said body are removably secured in position, said afterburner further including a pair of refractory material disks snugly removably received in the opposite ends of said body and seated against the inner surfaces of said end walls, the remote ends of said tube sections being abutted against the adjacent inner sides of said disks.

8. The combination of claim 1, wherein each of said chambers includes electrical resistance heater means therein selectively operable from the exterior of said body.

9. The combination of claim 8, wherein said tube sections are constructed of refractory material.

10. The combination of claim 9, wherein the opposing end walls of said body are removably secured in position, said afterburner further including a pair of refractory material disks snugly removably received in the opposite ends of said body and seated against the inner surfaces of said end walls, the remote ends of said tube sections being abutted against the adjacent inner sides of said disks.

11. The combination of claim 10, wherein said inlet means opens into said inlet portion of said body along a chord thereof and said outlet means opens ouwardly from said outlet portion of said body along a chord thereof.

* * * * *